US006446419B1

(12) United States Patent
Terwilliger

(10) Patent No.: US 6,446,419 B1
(45) Date of Patent: Sep. 10, 2002

(54) SWIVEL JOINT QUICK HITCH FOR HARNESS RACING

(76) Inventor: Al G. Terwilliger, 53 Massoit, Clawson, MI (US) 48017

( * ) Notice: Subject to any disclaimer, the term of this patent is extended or adjusted under 35 U.S.C. 154(b) by 0 days.

(21) Appl. No.: 09/687,394

(22) Filed: Oct. 13, 2000

Related U.S. Application Data

(60) Provisional application No. 60/191,504, filed on Mar. 23, 2000.

(51) Int. Cl.[7] ..... B68B 1/00
(52) U.S. Cl. ..... 54/64; 54/2
(58) Field of Search ..... 54/64, 40.1, 42.1, 54/1, 2

(56) References Cited

U.S. PATENT DOCUMENTS 451,381 A * 4/1891 Hutchinson ..... 54/69
934,304 A * 9/1909 Gooing ..... 54/2
3,144,741 A * 8/1964 Andersson ..... 54/23
3,942,305 A * 3/1976 Cameron ..... 54/2
4,473,991 A * 10/1984 Mura et al. ..... 54/2
4,480,428 A * 11/1984 Gilbertson ..... 54/69
4,986,059 A * 1/1991 Boutilier ..... 54/2
5,081,826 A * 1/1992 MacKay ..... 54/2
5,255,499 A * 10/1993 Hodsdon ..... 54/2

* cited by examiner

*Primary Examiner*—Peter M. Poon
*Assistant Examiner*—Son T. Nguyen
(74) *Attorney, Agent, or Firm*—James M. Deimen

(57) ABSTRACT

A harness racing quick hitch comprises a pair of swivel joints in the hitch. The pair of swivel joints permit the harness saddle to rotate about a vertical axis relative to the sulky arm. This rotation provides a degree of freedom not otherwise present in the connection of the sulky arm to the harness saddle. Thus, the swivel joints in the quick hitch separate further the flexing movement of the horse flanks from the rigidity of the sulky arms. Modifications to the swivel joints provide further freedom of movement to the horse and therefore comprise alternative embodiments of the new swivel joint quick hitch.

14 Claims, 3 Drawing Sheets

162
156
136
138
154
132
140
156
162
142
152
160

164
156
138
154
132
140
156
164
142
152
160

132
159
136
132
157

SWIVEL JOINT QUICK HITCH FOR HARNESS RACING

This application claims the benefit of U.S. Provisional Application No. 60/191,504, filed Mar. 23, 2000.

BACKGROUND OF THE INVENTION

The field of the invention pertains to harness racing of horses and, in particular, to the specialized equipment for attaching the sulky arms to the harness racing saddle.

Traditionally, sulky arms were attached on each side to the harness with an array of leather straps fastened to the harness, passing around the arm and through metal loops. A buckle on each strap was used to cinch up each strap to the proper tightness.

More recently, a metal quick hitch has come into use because of the ease and quickness provided in attaching each arm to the harness saddle. The current quick hitch (see FIG. 3 below) comprises a single welded rigid frame having a spring urged retractable pin for opening and closing the hitch connection to an arm. The frame is attached to the harness saddle by straps that normally are not disconnected from the frame or saddle. Thus, each arm can be quickly and easily detached and attached to the harness saddle without unbuckling and buckling leather straps.

Unfortunately, the single welded rigid frame forces the harness saddle to flex back and forth in movement with the gait thus fighting against the natural movement of the horse. The horse is restricted in its natural movements in the sulky causing problems such as rubbing and chafing of the flesh under the saddle.

SUMMARY OF THE INVENTION

Applicant has discovered that by providing a swivel joint in the quick hitch frame, firstly, and by further modifying the new swivel joint, an unexpected and surprisingly substantial improvement in the performance of the horse and sulky results.

The swivel joint in the quick hitch frame further separates the flexing movement of the horse flanks from the rigidity of the sulky arms. The currently used quick hitch and prior strapped attachment constricts the free movement of the horse by constricting the otherwise free movement of the harness saddle with the horse. With the swivel joint there is more freedom of movement of the harness saddle with the horse resulting in a more natural movement and more natural gait for the horse. Not only does the horse and sulky move faster, the horse is less likely to become lame, and in the less likely event the horse does become lame, the lameness will be less of a problem and the horse returned to full performance in less time.

The benefits of the swivel quick hitch to the horse are manifold. The horse can better develop its natural gait with a saddle harness that moves with the flesh of the horse and without the rubbing or scurving otherwise caused by the harness saddle. With less pain and no pinching, the horse is more pleasantly disposed to run and give its best. The result from testing has been a shaving of up to several full seconds in race times and less injury to the horse. Lameness is reduced.

BRIEF DESCRIPTION

DESCRIPTION OF THE PREFERRED EMBODIMENTS

Figure 1:
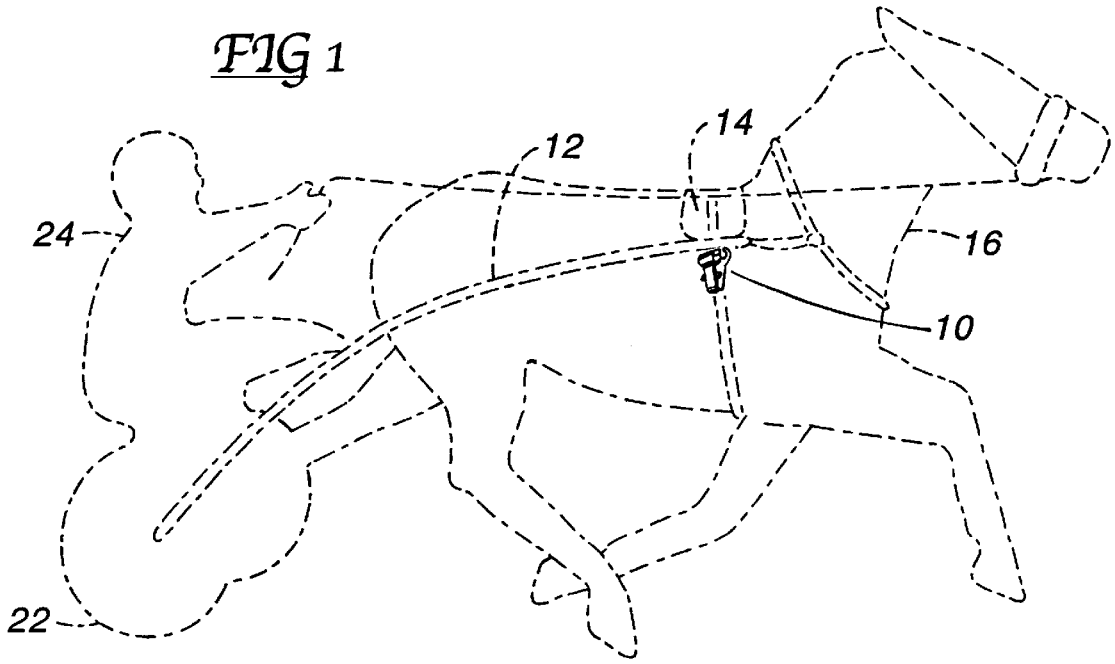
FIG. 1 is a view of a quick hitch with the horse, sulky and rider shown ghosted.
Figure 2:
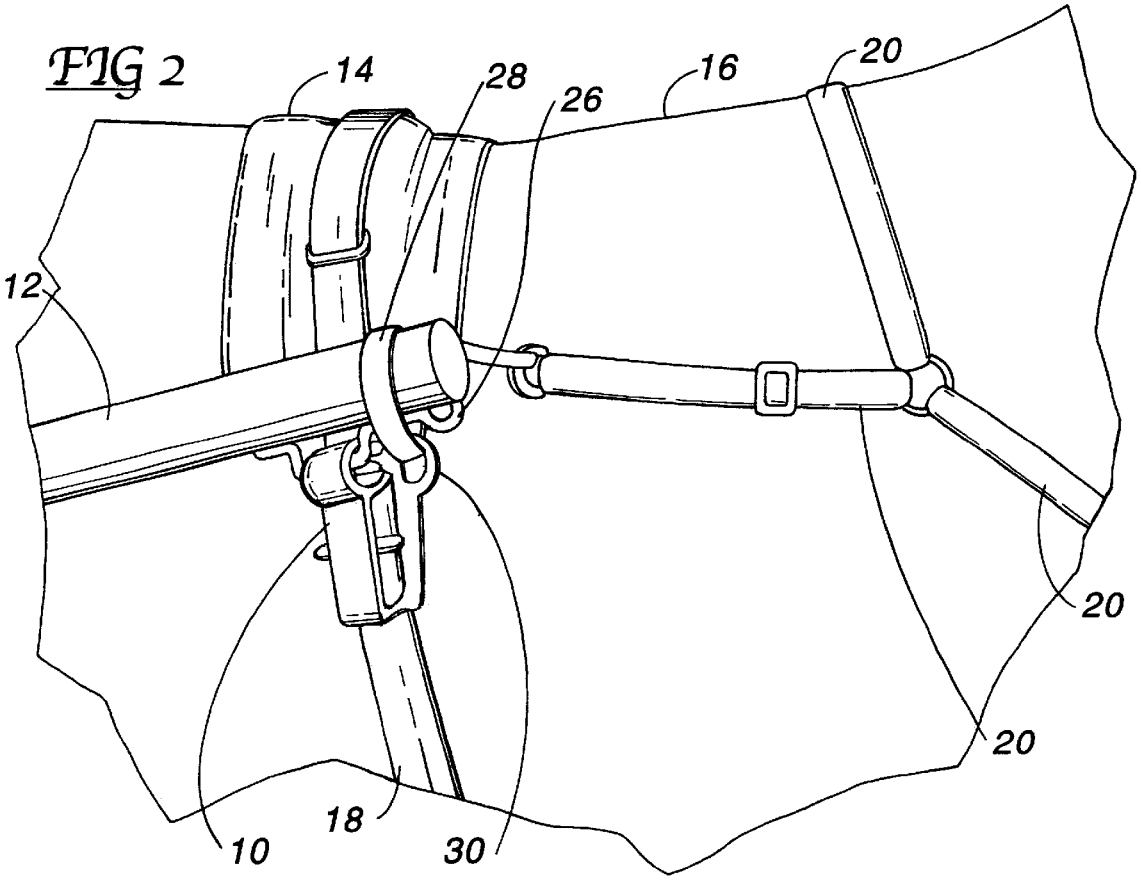
FIG. 2 is a side view of a harness saddle, sulky arm and quick hitch on a horse.

Illustrated in FIG. 1 is a quick hitch 10 in solid outline attaching a sulky arm 12 to the harness saddle 14 of a horse 16. As further shown in FIG. 2, the harness saddle 14 is held to the horse 16 by an understrap 18 and forward straps 20 to properly position the harness saddle for pulling the sulky arm 12 and sulky 22 with rider 24.

The quick hitch 10 is snapped to the quick hitch receiver 26, the quick hitch receiver being permanently attached to the arm 12. A safety strap or tape 28 encircles the arm 11 and quick hitch receiver 26 and passes through a loop 30, an integral part of the quick hitch 10.

Figure 3:
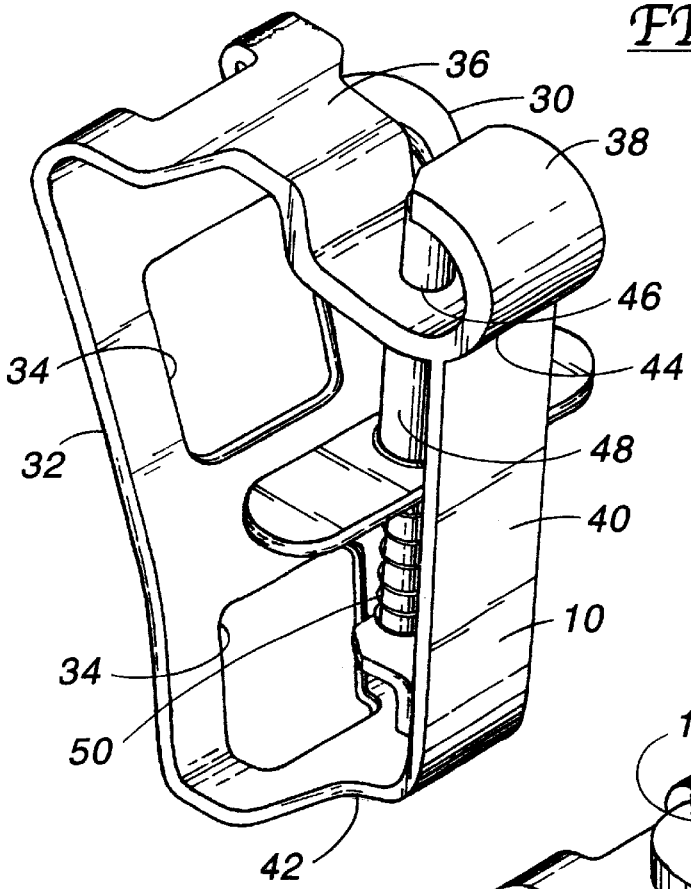
FIG 3 PRIOR ART
FIG. 3 is a perspective view of a current quick hitch.

Illustrated in FIG. 3 is the current quick hitch 10, usually constructed of stainless steel. The back portion 32 of the quick hitch 10 is formed with a plurality of apertures 34 for strapping the hitch to the harness saddle 14. The loop 30 also forms an integral part of the back portion 32. The top portion 36 of the hitch forms a tongue that partially loops back over to form a hook 38. The front portion 40 is bent up from the bottom 42 to join the top portion 36 at 44 with a weld. The top portion 36 is formed with a hole 46 for a movable pin 48, the pin being urged upward by a spring 50 to provide a normally closed hook 38. With the exception of the pin 48 and spring 50, the current quick hitch 10 is a solid weldment.

Figure 4:
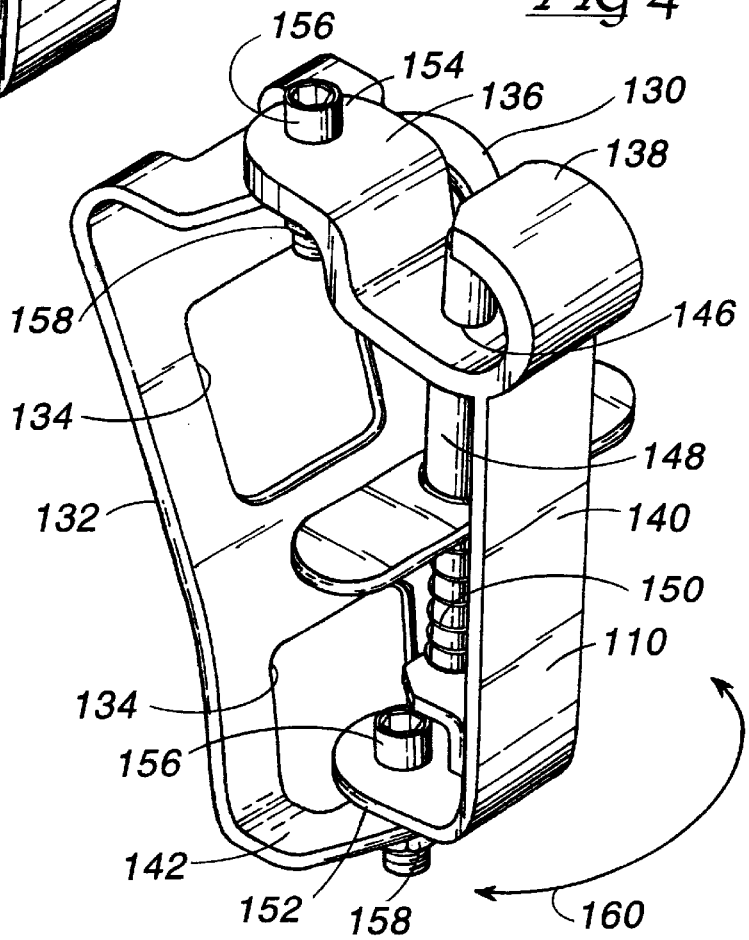

Illustrated in FIG. 4 is the new improved swivel hitch 110 wherein the back portion 132 is connected to the front portion 140 and the hook 138 by a swivel joint 152 at the bottom portion 142 and a substantially co-axial swivel joint 154 at the top portion 136. The apertures 134, movable pin 148 and hole 146, loop 130 and spring 150 are substantially unchanged.

As shown, the lower swivel joint 152 and upper swivel joint 154 are formed by machine screws 156 and lock nuts 158 of an alloy strong in shear. The machine screws 156 pass through holes (not shown) in the bottom portion 142 and top portion 136, the bottom and top portions each formed in two parts joined by the machine screws 156. The machine screws 156 are preferably made of an alloy only slightly softer than the stainless steel to provide wear in preference to the stainless steel. With machine screws 156 only slightly smaller in diameter than the holes through which they pass, the general configuration shown can provide 30°–45° of swivel to each side from the centered position shown. As an option, the machine screws 156 and holes may be provided with grommets (not shown) as a sacrificial intermediary to both quiet the swivel and protect both the machine screws and stainless steel hitch 10.

Figure 7:
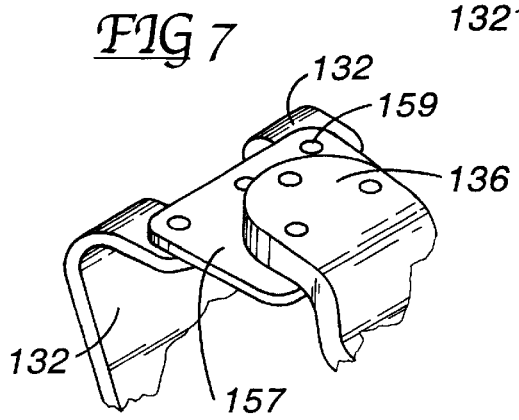
FIG. 7 is a detail of a third optional form of the swivel.

Although machine screws 156 and lock nuts 158 are shown, a variety of other fastener devices such as clevis pins or rivets might be employed. A strong flexible membrane at each swivel joint might also be employed to provide the relative movement between the back portion and the front portion. The membrane 157 as shown in FIG. 7 may be bonded or riveted 159 to the top portion 136 and back portion 132. Most important, the swivel joints 152 and 154 should be freely movable for maximum effectiveness as indicated by the arrow 160 in FIG. 4.

Figure 5:
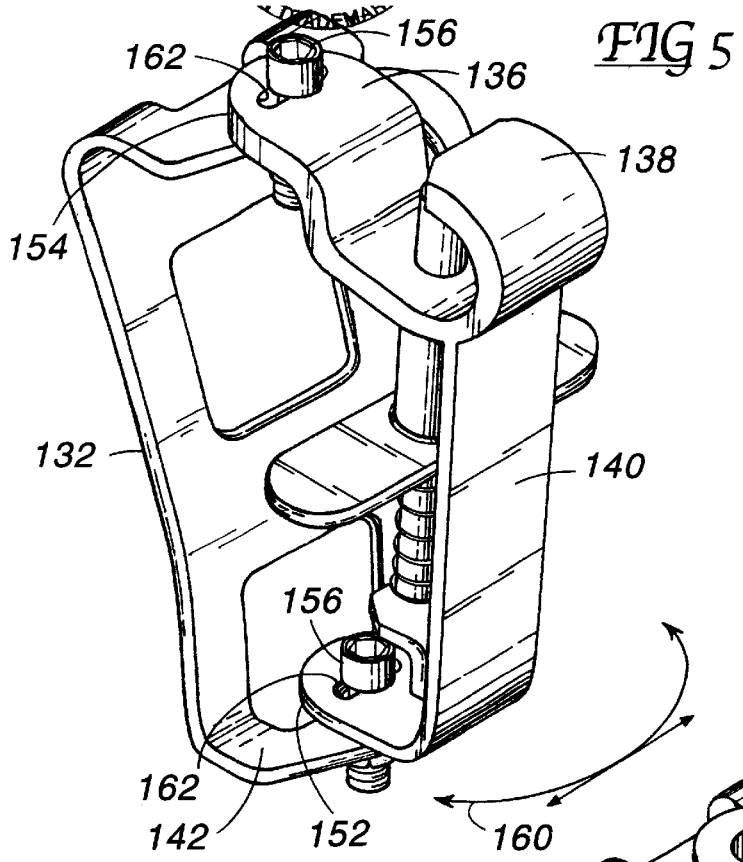
FIG. 5 is a detail of a first optional form of the swivel.

In testing prototype swivel joint quick hitches, further removal of the constraint on horse movement imposed by the sulky arms 12 was accomplished by changes in the configuration of the holes in the bottom portion 142 and top portion 136. Normally, in other environments and for other purposes, a free swivel joint is constructed for free rotational movement without appreciable translational movement or "slop." In FIG. 5, the first optional form of the swivel joint comprises slots 162 in one of the two parts of the top portion 136 and bottom portion 142 through which the machine screws 156 pass to form the swivel joints 154 and 152. The slots 162 may be either straight or arcuate and oriented generally perpendicular to the hook 138 as shown or at any angle relative to the hook.

Figure 6:
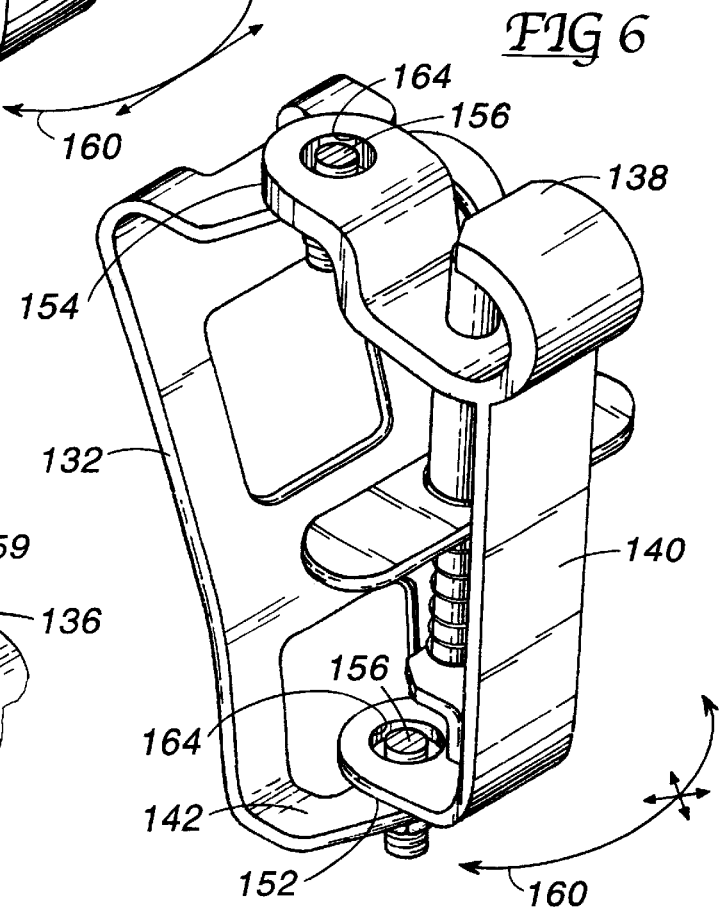
FIG. 6 is a detail of a second optional form of the swivel.

In a second embodiment as shown in FIG. 6, the swivel joints 152 and 154 are formed with significantly oversize round holes or oval holes 164 in either or both parts of the top portion 136 and bottom portion 142 through which the machine screws 156 pass. Thus, the machine screws 156 or rivets are free to move in any direction planar with the parts of the top portion 136 and bottom portion 142 to maximize freedom of movement of the swivel joints 152 and 154. This construction is best accomplished with rivets having heads of sufficient size to exceed the hole 164 minimum diameters.

What is claimed is:

1. In a harness racing sulky arm to saddle hitch having a front portion and a back portion, a connection device on the front portion for attachment to a sulky arm and at least one aperture on the back portion for attachment to a harness saddle, the improvement characterized by first parts on the front portion and back portion forming a top portion and second parts on the front portion and back portion forming a bottom portion, a pair of swivel joints laying on substantially one axis of rotation joining the first parts together and the second parts together for movement of the front portion relative to the back portion, said back portion and first part and second part on the back portion forming a rigid back portion.

2. The harness racing hitch of claim 1 wherein the at least one swivel joint is limited to rotational motion of the front portion relative to the back portion.

3. The harness racing hitch of claim 1 wherein the at least one swivel joint also is formed to permit translational movement of the front portion relative to the back portion.

4. The harness racing hitch of claim 1 wherein the at least one swivel joint comprises at least one flexible membrane connecting the back portion to the front portion.

5. The harness racing hitch of claim 1 wherein the at least one swivel joint comprises at least one slot substantially parallel to the sulky arm.

6. The harness racing hitch of claim 1 wherein the at least one swivel joint comprises at least one oval hole.

7. The harness racing hitch of claim 1 wherein the at least one swivel joint comprises at least one hole oversize relative to the fastener there through.

8. The harness racing hitch of claim 1 wherein the rotational movement of the front portion relative to the back portion is limited to 30° to 45° of swivel to each side of a center position defined by substantially parallel front and back portions.

9. In a hitch for attaching a harness racing sulky arm to a saddle, the hitch comprising a generally U-shaped front portion having upper & lower legs and a generally U-shaped back portion having upper & lower legs, the upper legs of the U-shaped front portion and U-shaped back portion forming a top portion and the lower legs of the U-shaped front portion and U-shaped back portion forming a bottom portion, a connection mechanism on the front portion for attachment to a sulky arm and a plurality of apertures in the back portion for attachment to a harness saddle, a pair of first holes in the top portion of the hitch and a first fastener in the first holes to form a top swivel joint, and a pair of second holes in the bottom portion of the hitch and a second fastener in the second holes to form a bottom swivel joint, said generally U-shaped back portion being rigid between the top swivel joint and bottom swivel joint.

10. The harness racing hitch of claim 9 wherein the pair of first holes and pair of second holes are generally co-incident with a single swivel axis.

11. The harness racing hitch of claim 9 wherein at least one hole of the pair of first holes and pair of second holes in the top and bottom portions is slot shaped for translational movement of the front portion relative to the back portion.

12. The harness racing hitch of claim 9 wherein at least one hole of the pair of first holes and pair of second holes in the top and bottom portions is oval shaped for translational and rotational movement of the front portion relative to the back portion.

13. The harness racing hitch of claim 9 wherein at least one hole of the pair of first holes and pair of second holes in the top and bottom portions is oversize relative to the fastener there through for translational and rotational movement of the front portion relative to the back portion.

14. The harness racing hitch of claim 9 wherein the rotational movement of the front portion relative to the back portion is limited to 30° to 45° of swivel to each side of a center position defined by substantially parallel front and back portions.

* * * * *